United States Patent [19]

Shipley

[11] Patent Number: 5,054,547

[45] Date of Patent: Oct. 8, 1991

[54] VERTICAL TUBE HEAT EXCHANGER APPARATUS HAVING RESILIENT DISTRIBUTOR DEVICES AND A RESILIENT DISTRIBUTOR DEVICE THEREFOR

[75] Inventor: Kenneth R. Shipley, Memphis, Ind.

[73] Assignee: Henry Vogt Machine Co., Louisville, Ky.

[21] Appl. No.: 589,278

[22] Filed: Sep. 28, 1990

[51] Int. Cl.[5] ..... F28D 3/02

[52] U.S. Cl. ..... 165/115; 165/118; 165/174; 239/193

[58] Field of Search ..... 165/115, 118, 174; 239/193

[56] References Cited

U.S. PATENT DOCUMENTS 4,199,537 4/1980 Zardi et al. ..... 165/118

FOREIGN PATENT DOCUMENTS 234720 4/1986 German Democratic Rep. ..... 165/118

*Primary Examiner*—Albert W. Davis, Jr.

*Attorney, Agent, or Firm*—Jon C. Winger

[57] ABSTRACT

A vertical tube heat exchanger having a shell enclosing a bottom tubesheet, a top tubesheet in parallel, spaced-apart relationship to the bottom tubesheet, and a plurality of spaced-apart parallel flow tubes extending between the top tubesheet and bottom tubesheet includes liquid distributor devices inserted into the open top end of the flow tubes. The distributors are fabricated of an elastic material of sufficient resilience to sustain deformation circumferentially of the distributor device to accomodate irregularities in the tube wall at the top end creating a continuous uninterrupted peripheral seal at the interface of the distributor and tube wall at the open top end when inserted in the tube open top end, and to recover the original peripheral size and form of the distributor when the distributor is removed from the tube open top end.

19 Claims, 2 Drawing Sheets

VERTICAL TUBE HEAT EXCHANGER APPARATUS HAVING RESILIENT DISTRIBUTOR DEVICES AND A RESILIENT DISTRIBUTOR DEVICE THEREFOR

BACKGROUND OF THE INVENTION

The present invention relates to vertical tube heat exchangers and evaporators, and more particularly to liquid distributors therefor which are fabricated of an elastic material of sufficient resiliency to provide recovery of the distributor to its original size and form when removed from the tubes of the exchanger or evaporator even after sustained use.

Conventional vertical tube heat exchangers or evaporators known to me include a shell enclosing a top tubesheet, a bottom tubesheet in spaced apart, parallel orientation to the top tubesheet, and parallel liquid flow tubes extending between the top and bottom tubesheets, a rigid liquid distributor inserted into the open top ends of the tubes. The tubes are connected to the tubesheets by various methods such as expansion, welding or a combination of expansion and welding. Due to the manufacturing methods used to expand or weld the tubes to the tubesheet, significant dimensional variations can occur at the open top ends of the tubes. Further, when welding is used to attach the tubes to the tubesheets, high and low spots, and weld overhang can occur which will result in a tube opening which is rough, or irregular in peripheral shape, or out of round even if smooth and regular in peripheral form, as well as being over-sized or undersized from nominal. A mixture of these conditions can occur from tube to tube across the tubesheet. These conditions obviously create numerous production problems in the manufacture of vertical tube heat exchangers. One problem is that a necessary peripheral seal between the rigid liquid distributor device inserted into the top open tube end may not be created thereby allowing liquid to leak between the distributor and tube end resulting in a destruction of the desired smooth spiral flow pattern of liquid from the distributor into and downwardly through the tubes. When the open tube end is irregular, either in shape, size, but most especially when the irregularity is caused by weld overhang, weld start and stop irregularities, or when the open tube end is undersized, it is extremely difficult to insert the distributor into the open tube end and obtain a seal between the distributor and periphery of the open tube end. In many such cases, in order to insert the distributor into the open tube end to a proper depth therein and so that an adequate peripheral seal is created, the distributor must be violently forced into the open tube end by repeated hammer blows. This can result in damage to the distributor. As a further consequence of forcing the distributor into the open tube end, removal of a distributor for cleaning or other maintenance service can be extremely difficult and often results or requires the destruction of the distributor. A further problem, particularly when the tube irregularity is an oversized open tube end, or a weld start and stop irregularity, is that the distributor will frequently pop or vibrate out of the open tube end during either shipment of the heat exchanger or operation of the heat exchanger under turbulent flow conditions.

Examples of various known vertical tube heat exchangers and distributors used in such heat exchangers are shown in the following U.S. Patents:

| U.S. Pat. No. | Issued | To |
|---|---|---|
| 2,424,441 | July 22, 1947 | Edmonds |
| 2,949,935 | August 23, 1960 | Edmonds |
| 3,016,067 | January 9, 1962 | Edmonds |
| 3,934,574 | January 27, 1976 | Johnson |
| 4,134,939 | January 16, 1979 | Zardi |
| 4,135,597 | January 23, 1979 | Mattern |
| 4,154,642 | May 15, 1979 | Mattern |
| 4,199,537 | April 22, 1980 | Zardi |
| 4,248,296 | February 3, 1981 | Jezek |
| 4,572,287 | February 25, 1986 | Allo |

To the best of my knowledge, all heretofore known distributors have been fabricated of metal or rigid plastic.

SUMMARY OF THE INVENTION

The present invention recognizes the draw backs of the heretofore known rigid distributors in a vertical tube heat exchanger, and provides a solution which is straightforward.

The present invention provides a vertical tube heat exchanger apparatus comprising a shell, a bottom tubesheet located in the shell proximate the bottom end of the shell, the bottom tubesheet being formed with a plurality of tube bottom end receiving apertures, a top tubesheet located in the shell spaced apart from and above the bottom tubesheet, the top tubesheet being formed with a plurality of tube top end receiving apertures equal in number to the number of tube bottom end receiving apertures, and each one of the tube top end receiving apertures being in alignment with a different one of the tube bottom end receiving apertures, a plurality of parallel liquid flow tubes extending between the top and bottom tubesheets, each tube having the top end received in one of the tube top end receiving apertures and the bottom end received in the aligned one of the tube bottom end receiving apertures, and a distributor having a generally cylindrical side wall defining an interior distributor chamber coaxially inserted into the open top end of each tube, the outside circumferential dimension of the distributor side wall being larger than the inside peripheral dimension of the tube open top end sufficient to produce an interference fit therebetween, the distributor side wall being fabricated of a material which is of sufficient resilience to be compressively deformable circumferentially of the distributor side wall and conform to irregularities in the tube open top end creating a continuous, uninterrupted peripheral seal at the interface of the distributor side wall and the tube open top end when the distributor is inserted in the tube open top end, and to recover to the original peripheral size and form of the distributor side wall when the distributor is removed from the tube open top end.

The present invention also provides a water distributor to be installed into the open top end of the upright tubes in a vertical tube-type heat exchanger, comprising a circumferential side wall having at least a tapered portion on the outer surface thereof, a top wall closing the top end of the circumferential side wall integrally formed with the circumferential side wall, the top wall cooperating with the circumferential side wall to define an internal chamber open to the bottom end of the circumferential side wall, a plurality of liquid inlet passageways formed through the peripheral side wall providing for liquid flow into the internal chamber, the tapered portion of the circumferential side wall having circumferential dimensions larger than the inside peripheral dimension of the tube open top end sufficient to provide a press fit therebetween, the distributor side wall being fabricated of a material which is of sufficient resilience to be compressively deformable circumferentially of the distributor side wall to conform to irregularities in the tube open top end to create a continuous uninterrupted peripheral seal at the interface of the tapered portion of the distributor side wall and the perimeter of the tube open top end when the distributor is inserted in the tube open top end, and to be recoverable to the original peripheral size and form of the tapered portion of the distributor side wall when the distributor is removed from the tube open top end.

BRIEF DESCRIPTION OF THE DRAWINGS

The present invention will become even more clear upon reference to the following description in conjunction with the accompanying drawings, wherein like numerals refer to like parts throughout the several views and in which.

DETAILED DESCRIPTION OF THE PREFERRED EMBODIMENTS

Figure 1:
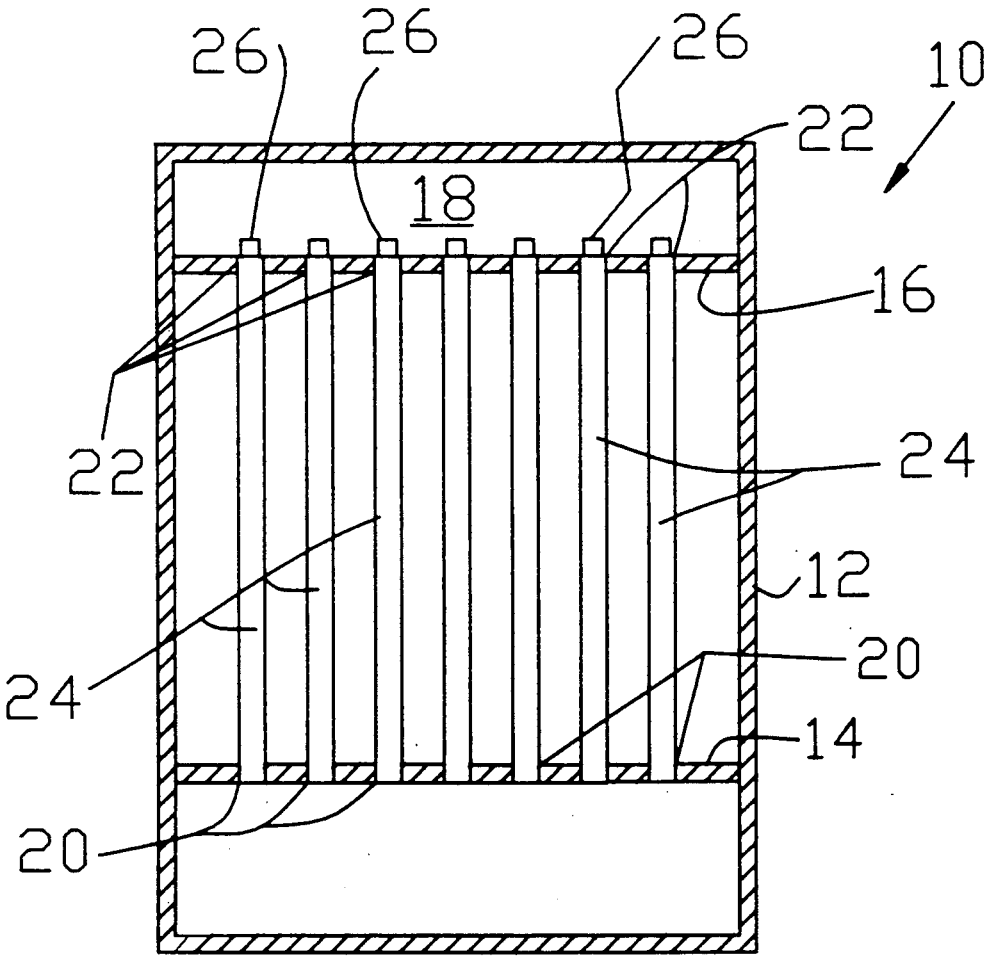
FIG. 1 is a schematic cross-sectional side view of a vertical tube heat exchanger device embodying the distributor device of the present invention.

With reference to FIG. 1, there is illustrated a vertical tube heat exchanger apparatus, generally denoted as the numeral 10. Such vertical tube heat exchanger apparatus 10 are commonly referred to as, for example, falling film heat exchangers, or freezers, or evaporators and are used, in one preferred application, as an ice making machine to make tubular ice wherein the falling film is water which is gradually frozen as it flows down the inside surface of the tubes. The vertical tube heat exchanger apparatus comprises an outer shell 12 having a bottom tubesheet 14 horizontally located within the shell 12 proximate the bottom end of the shell 12, and a top tubesheet 16 horizontally located within the shell 12 above and parallel to the bottom tubesheet 14. A liquid header 18 is defined within the shell 12 above the top tubesheet 16. The bottom tubesheet 14 is formed with an array of spaced-apart tube bottom end receiving apertures 20, and the top tubesheet 16 is formed with an identical array of spaced-apart tube top end receiving apertures 22. The number of tube bottom end receiving apertures 20 are equal in number to the number of tube top end receiving apertures 22, and each one of the tube top end receiving apertures 22 is in alignment with a different one of the tube bottom end receiving apertures 20. A plurality of parallel liquid flow tubes 24 extend vertically between the bottom tubesheet 14 and the top tubesheet 16. Each flow tube 24 has its top end received in one of the tube top end receiving apertures 22 and its bottom end received in the aligned one of the tube bottom end receiving apertures 20. The tubes 24 are secured to the bottom and top tubesheets 14 and 16, respectively, by known expansion processes, welding, brazing or combination of expansion and welding or brazing.

With continued reference to FIG. 1 and additional reference to FIGS. 2, 3, 4 and 5, a liquid distributor, generally denoted as the numeral 26, is inserted into the open top end 28 of each of the liquid flow tubes 24 to distribute liquid from the liquid header 18 into the interior of the vertical tubes 24. The distributor 26 includes a generally cylindrical side wall 30 and a top wall 32 closing the top end of the side wall 30 integrally formed with the side wall 30. The side wall 30 and top wall 32 cooperate to define an internal chamber 34 open to the bottom end of the side wall 30. A plurality of passageways 36 are formed through the side wall 30, just below the top wall 32, generally tangentially to the cylindrical side wall 30 defining liquid inlets into the chamber 34 of the distributor 26 from the liquid header 18. As can be best seen in FIGS. 2, 3, 4 and 5, the exterior surface of the generally cylindrical side wall 30 is formed with an exterior circumferential step 38 spaced a distance below the top wall 32 so that an upper region 40 of the side wall 30 is cylindrical. The tangential passageways 36 are formed through the side wall 30 in the upper region 40. An intermediate region 42 of the exterior surface of the side wall 30 conically tapers downwardly from the step 38 and blends with a cylindrical lower region 44 of the side wall 30. The interior surface of the lower region 44 is circumferentially chamfered at the bottom cylindrical edge of the side wall 30 to provide a smooth transitional path for liquid flowing over the interior circumferential surface of the side wall 30 to the interior circumferential wall surface 46 of the tube 24 below the open top end 28 of the tube 24. The outside circumference of the lower region 44 of the side wall 30 is less than the circumference of the inside circumference of the tube 24, and, of course, the tapered intermediate region 42 provides a sequence of circumferences which are increasingly larger than the inside periphery of the tubes 24 progressing from the interface of the intermediate region 42 and lower region 44 upwardly along the intermediate region 42 toward the circumferential step 38. The distributor 26 further includes a plurality of parallel vertical ribs 48 formed on the exterior surface of the lower region 44 extending longitudinally of the lower region of the cylindrical side wall 30 from the bottom edge of the lower region 44 to approximately the interface of the lower region 44 and intermediate region 42. The ribs 48 are spaced equally apart from each other circumferentially of the lower region 44. As shown, there are three ribs spaced apart 120° from each other around the circumference of the lower region 44. The ribs 48 project outward from the exterior surface of the lower region 44 of the distributor 26 such that the distance between the projecting side edges of oppositely disposed ribs 48 diametrically of the distributor lower region 44 is larger than the inside diameter of the tubes 24. The ribs 48 function to center the distributor 26 in the tube 24 and also to generate an interference fit between the ribs 48 and interior wall surface 46 of the tube 24.

Figure 2:
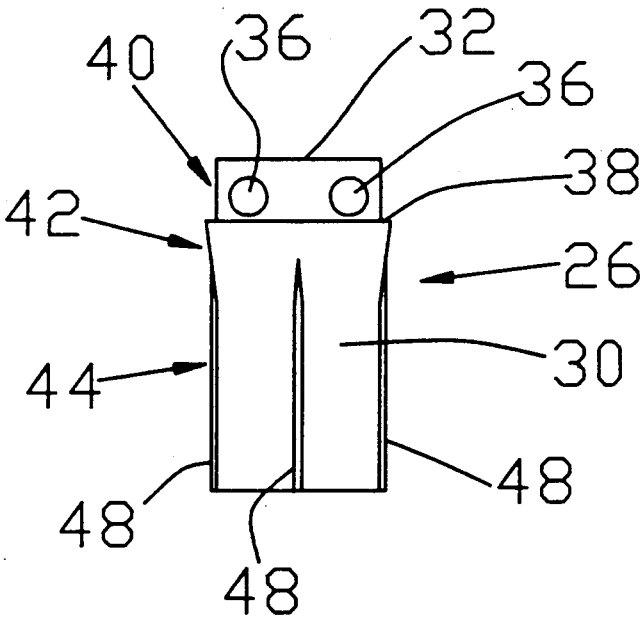
FIG. 2 is a side view of one embodiment of a distributor device of the present invention.
Figure 3:
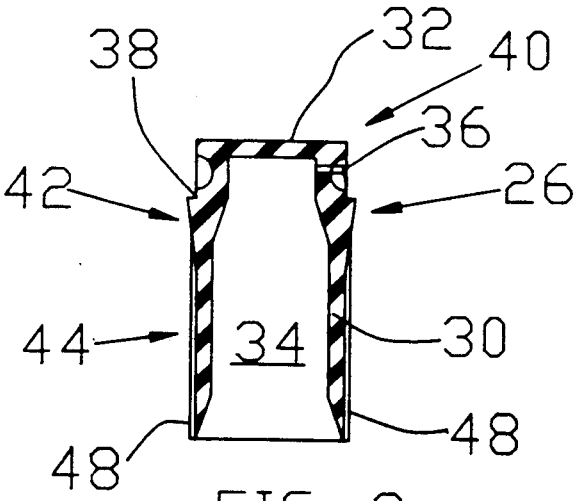
FIG. 3 is a cross-sectional side view of the distributor device of FIG. 1.
Figure 5:
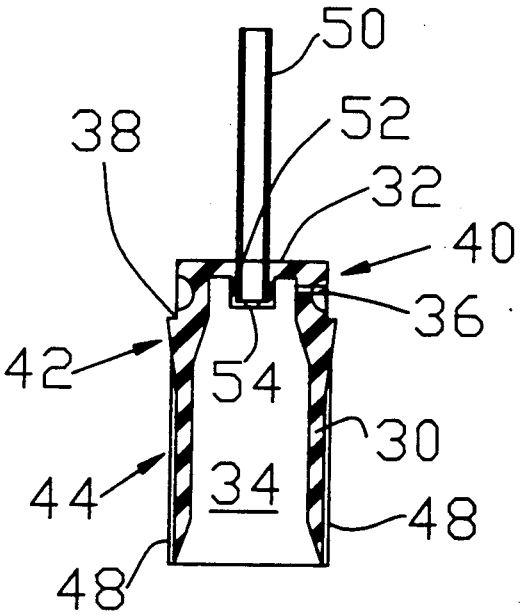
FIG. 5 is a cross-sectional side view of the distributor device of FIG. 4.
Figure 4:
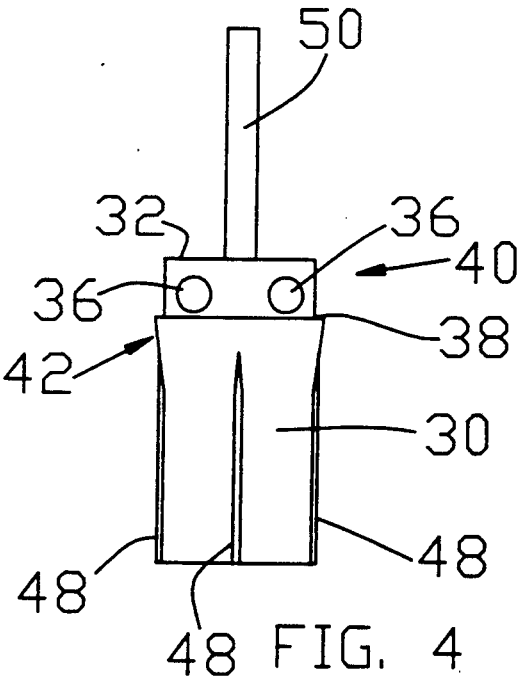
FIG. 4 is a side view of another embodiment of a distributor device of the present invention.

The distributor 26 of FIGS. 4 and 5 is substantially identical to the distributor 26 of FIGS. 2 and 3 except that the distributor 26 of FIGS. 4 and 5 includes an additional feature. In the distributor 26 of FIGS. 2 and 3, the top wall 32 is closed. However, in some uses of the vertical tube heat exchanger apparatus 10, there exists a relatively low static head of fluid in the liquid header 18 above the distributors 26. In applications wherein the vertical tube heat exchanger apparatus 10 is a tubular ice making machine, a relatively low static head of water in the liquid header 18 below atmosphere, for example less than six inches, will create a siphoning effect when the inside diameter of the tubular ice being formed inside the tubes 24 reaches a particular critical size. With a distributor 26 (see FIGS. 2 and 3) having a closed top wall 32, a suction will be created by the siphoning effect which greatly increases the flow of water from the liquid header 18 through the passageways 36 in the distributor 26 into the chamber 34 of the distributor 26. This condition is alleviated by providing the distributor 26 (see FIGS. 4 and 5) with a vent tube 50 which provides fluid communication between the liquid header 18 and the interior chamber 34 of the distributor 24 which, therefore, functions to prevent a vacuum from being formed thereby eliminating any siphoning effect. As shown in FIGS. 4 and 5, the top wall 32 of the distributor 26 is formed with a cylindrical pocket 52 having an aperture 54 through the bottom side open to the interior chamber 34. The bottom end of the vent tube 50 is received in the pocket 52 coaxial with the aperture 54 and projects upwardly from the distributor top wall 32 into the liquid header 18.

The distributor 26 of the invention, unlike the previously known distributors, is fabricated of a material which is of sufficient resilience so that the tapered portion 42 and lower portion 44 will be compressively circumferentially deformed and conform to irregularities in the shape and size of the open top end 28 of the tube 24 and provide compressive resilience to the ribs 48 on lower portion 44, and of sufficiently high elastic modulus to create a continuous uninterrupted peripheral seal between the inside peripheral edge at the open top end 28 of the tube 24 and tapered portion 42 as well as generate a tight interference fit between the ribs 48 and the interior wall surface 46 of the tube 24 when the distributor 26 is inserted in the tube 24, and also of sufficiently high yield value to recover to the original circumferential size and shape of the distributor side wall 30 without plastic deformation when the distributor 26 is removed from the tube 24. More particularly, the distributor 26 of the invention fulfills the above characteristics after prolonged exposure to liquid in a temperature range of about −40° F. to about 150° F., and maintains a durometer in the range of about 92 A to 50A. Preferably, when the distributor 26 is utilized in a falling film heat exchanger apparatus 10 to make tubular ice, the distributor 26 of the invention fulfills the above characteristics after prolonged exposure to water in a temperature range of about 32° F. to about 90° F., and maintains a durometer in a range of about 90 A to 50 A. In addition, the distributor 26 provides an interference fit between the ribs 48 on the lower region 44 and the interior wall surface 46 of the tube 24 of between about 0.015 inches and at least 0.001 inches. One such material which has been discovered to fulfill the above requirements is a thermoplastic elastomer sold by Monsanto under the trademark "SANTOPRENE 271-87" and another is a thermoplastic elastomer also sold by Monsanto under the trademark "SANTOPRENE 101-87".

Figure 6:
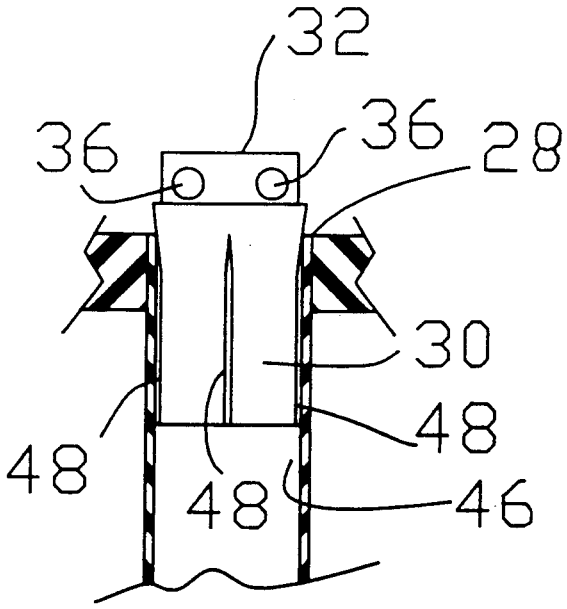
FIG. 6 is an enlarged view, in cross-section, of a portion of the vertical tube heat exchanger apparatus of FIG. 1, more clearly showing the distributor device of FIGS. 2–5 inserted into a tube of the vertical tube heat exchanger apparatus.

Now with reference to FIG. 6, the distributor 26 is installed in a tube 24 by positioning the lower cylindrical region 44 of the distributor 26 concentrically within the open top end 28 of the tube 24 and pushing the distributor 26 downwardly until the conically tapered intermediate region 42 circumferentially engages the inside peripheral edge of the tube 24 at the open top end 28 of the tube 24, and ribs 48 on the lower portion 44 cooperate with the interior surface 46 of the tube 24 with a press fit. The circumferential engagement of the tapered region 42 with the inside peripheral edge at the tube open top end 28 provides a narrow circumferential line of compression of the tapered portion 42 resulting in a liquid-tight seal at the interface due to the compression of the tapered portion 42.

The above-discussed distributor 26 of the present invention overcomes the drawbacks of the heretofore known distributors. The distributor 26 of the present invention is of sufficient resilience to conform to irregular shapes of the peripheral edge of open top end 28 of the tube due to, for example, weld start-stop discontinuity, weld overhang, high and low spots around the periphery of the open tube top end 28, irregular shapes of the peripheral edge of the open top end 28 due to expansion processes, undersized open top tube ends 28, as well as creating a sufficient interference fit with oversized open top tube ends 28 to prevent the distributor 26 from being jarred or vibrated out of the open top tube end 28 under turbulent flow conditions within the design operating range of the apparatus 10. In addition, the distributor 26 of the present invention can be removed from the open top tube end 28 for maintenance, such as cleaning, without destruction to the distributor, and recover its original size and form or shape so that the distributor 26 can be re-installed in the open top tube end 28, thereby saving operating and maintenance expenses of the apparatus 10.

The foregoing detailed description is given primarily for clearness of understanding and no unnecessary limitations are to be understood therefrom for modifications will become obvious to those skilled in the art upon reading this disclosure may be made without departing from the spirit of the invention and scope of the appended claims.

What is claimed is:

1. A vertical tube heat exchanger apparatus comprising:

a shell;

a bottom tubesheet located in the shell proximate the bottom end of the shell, the bottom tubesheet being formed with a plurality of tube bottom end receiving apertures;

a top tubesheet located in the shell spaced above and parallel to the bottom tubesheet, the top tubesheet being formed with a plurality of tube top end receiving apertures equal in number to the number of tube bottom end receiving apertures, and each one of the tube top end receiving apertures being in alignment with a different one of the tube bottom end receiving apertures;

a plurality of parallel flow tubes extending between the top and bottom tubesheets, each tube having the open top end received in one of the tube top end receiving apertures of the top tubesheet and the open bottom end received in the aligned one of the tube bottom end receiving apertures of the bottom tubesheet; and, a distributor having a generally cylindrical side wall defining an interior chamber coaxially inserted into the open top end of each tube, a plurality of ribs integrally formed on the exterior surface of the cylindrical side wall extending longitudinally of the cylindrical side wall and projecting outwardly from the distributor side wall to provide an interference fit with the inside peripheral dimension of the tube open top end;

the distributor being fabricated of a material which is of sufficient resilience to be compressively deformed circumferentially of the distributor side wall to conform to irregularities in shape and size of the tube open top end, to create a continuous uninterrupted peripheral seal at the interface of the distributor side wall and the circumferential top edge of the tube open top end when the distributor is inserted in the tube open top end, and to recover the original circumferential size and shape of the distributor side wall when the distributor is removed from the tube open top end.

2. The heat exchanger apparatus of claim 1, wherein the plurality of vertical ribs are integrally formed on the exterior surface of a lower region of the distributor side wall, are equally spaced apart from each other circumferentially of the distributor side wall and project radially outwardly of the exterior surface of the distributor side wall by a distance sufficient to provide an interference fit with the interior wall surface of the tube in the range of about 0.001 inches to about 0.015 without permanent deformation.

3. The heat exchanger apparatus of claim 1, wherein the distributor has a closed top wall integrally formed with the circumferential side wall.

4. The heat exchanger apparatus of claim 1, wherein the distributor has a top wall integrally formed with the circumferential side wall, means defining a vent tube receiving pocket formed in the top wall, means defining an aperture through the bottom side of the pocket open to the interior chamber, and a vent tube having a lower end received in the vent tube receiving pocket and projecting upwardly from the top wall of the distributor.

5. The heat exchanger apparatus of claim 1, wherein the distributor retains the resilience after prolonged exposure to a temperature of about −40° F.

6. The heat exchanger apparatus of claim 1, wherein the distributor retains the resilience after prolonged exposure to temperatures up to about 150° F.

7. The heat exchanger apparatus of claim 1, wherein the distributor retains the resilience after prolonged exposure to temperatures in the range of about −40° F. to about 150° F.

8. The heat exchanger apparatus of claim 7, wherein the distributor retains the resilience after prolonged exposure to temperatures in the range of about 32° F. to about 90° F.

9. The heat exchanger apparatus of claim 1, wherein the distributor has a durometer in the range of about 92 A to about 50 A.

10. The heat exchanger apparatus of claim 1, wherein the distributor has a durometer in the range of about 90 A to about 50 A at a temperature in the range of about 32° F. to about 90° F.

11. A liquid distributor to be inserted into the open top end of an upright tube in a vertical tube heat exchanger, comprising:

a generally circumferential side wall;

a top wall closing the top end of the circumferential side wall, integrally formed with the side wall, and cooperating with the circumferential side wall to define an internal chamber;

a plurality of passageways formed through the side wall defining liquid passage inlets into the internal chamber;

a plurality of vertical ribs integrally formed on the exterior surface of a lower region of the distributor side wall, equally spaced apart from each other circumferentially of the distributor side wall and projecting radially outwardly of the exterior surface of the distributor side wall by a distance sufficient to provide an interference fit with the interior wall surface of the tube;

the distributor being formed of a material which is of sufficient resilience to be compressively deformed circumferentially of the side wall and circumferentially conform to irregularities in shape and size of the tube open top end, to create a continuous uninterrupted peripheral seal at the interface of the distributor side wall and circumferential tube open top end and to generate a tight interference fit at the interface of the side wall and the tube open top end when inserted in the tube open top end, and to recover the original size and shape of the distributor side wall when the distributor is removed from the tube open top end.

12. The distributor of claim 11, wherein the ribs are sized to provide an interference fit in the range of about 0.001 inches and 0.015 inches without permanent deformation.

13. The distributor of claim 11, wherein the distributor retains the resilience after prolonged exposure to a temperature of about 32° F.

14. The distributor of claim 11, wherein the distributor retains the resilience after prolonged exposure to temperatures up to about 90° F.

15. The distributor of claim 11, wherein the distributor retains the resilience after prolonged exposure to temperatures in the range of about 32° F. to about 90° F.

16. The distributor of claim 11 having a durometer in the range of about 50 A to about 90 A.

17. The distributor of claim 11 having a durometer of at least 90 A at a temperature of about 32° F.

18. The distributor of claim 11 having a durometer in the range of about 90 A to about 50 A at a temperature in the range of about 32° F. to about 90° F.

19. The distributor of claim 11, wherein the distributor comprises means defining a vent tube receiving pocket formed in the top wall, means defining an aperture through the bottom side of the pocket open to the chamber, and a vent tube having a lower end received in the vent tube receiving pocket and projecting upwardly from the top wall of the distributor.

* * * * *